US008528751B2

(12) United States Patent
Klein et al.

(10) Patent No.: US 8,528,751 B2
(45) Date of Patent: Sep. 10, 2013

(54) GIFT BOX WITH INDIVIDUALLY ROTATABLE COMPARTMENTS

(75) Inventors: Ross Klein, Los Angeles, CA (US); Dominic DeMaria, Central Point, OR (US); Brian Raymond, Medford, OR (US)

(73) Assignee: Harry and David, LLC, Medford, OR (US)

( * ) Notice: Subject to any disclaimer, the term of this patent is extended or adjusted under 35 U.S.C. 154(b) by 455 days.

(21) Appl. No.: 12/889,317

(22) Filed: Sep. 23, 2010

(65) Prior Publication Data

US 2012/0074023 A1 Mar. 29, 2012

(51) Int. Cl.
*A47G 29/00* (2006.01)

(52) U.S. Cl.
USPC ..... 211/73; 211/74; 211/78; 211/131.1

(58) Field of Classification Search
USPC ..... 211/73, 144, 133.4, 131.1, 163, 168, 211/150, 129.1, 132.1, 74, 77, 78, 72; 312/123, 312/324, 326, 329; 220/4.26, 4.27; 248/300
See application file for complete search history.

(56) References Cited

U.S. PATENT DOCUMENTS

| | | | | |
|---|---|---|---|---|
| 1,090,592 | A | | 3/1914 | Betham |
| 2,582,421 | A | | 1/1952 | Essman |
| 2,665,563 | A | | 1/1954 | Walker |
| 3,169,740 | A | * | 2/1965 | Beckett ..... 248/519 |
| 3,188,157 | A | | 6/1965 | Rand |
| 3,498,471 | A | | 3/1970 | Dirkx |
| 4,289,245 | A | * | 9/1981 | Hasulak ..... 211/133.4 |
| D267,153 | S | | 12/1982 | Lebowitz |
| 4,815,483 | A | * | 3/1989 | DuGrenier et al. ..... 132/295 |
| 5,096,073 | A | * | 3/1992 | O'Brien ..... 211/163 |
| 5,154,392 | A | * | 10/1992 | Voight ..... 248/558 |
| 5,246,020 | A | | 9/1993 | Wu |
| 5,370,255 | A | | 12/1994 | Yang |
| 5,441,163 | A | | 8/1995 | Carrasco |
| D368,396 | S | * | 4/1996 | Bidwell ..... D6/479 |
| 5,676,240 | A | | 10/1997 | Cziraky et al. |
| 6,145,515 | A | | 11/2000 | Wu |
| 6,648,390 | B1 | | 11/2003 | Yang |

FOREIGN PATENT DOCUMENTS

DE 29608833 U1 * 8/1996

* cited by examiner

*Primary Examiner* — Korie H Chan
(74) *Attorney, Agent, or Firm* — Stoel Rives LLP

(57) ABSTRACT

A gift box includes a base compartment and a plurality of stacking compartments supported on a tubular sleeve. The sleeve forms a pivot axis for the stacking compartments such that the stacking compartments are independently rotatable about the pivot axis relative to the base compartment. The sleeve forms a compartment for a gift item, such as a bottle of wine, which may add rigidity to the pivot axis. The base compartment, stacking compartment, and sleeve may each be folded from a unitary sheet of recyclable material, such as corrugated fiberboard.

20 Claims, 9 Drawing Sheets

GIFT BOX WITH INDIVIDUALLY ROTATABLE COMPARTMENTS

FIELD OF THE DISCLOSURE

The field of this disclosure relates to containers and, more particularly, gift boxes having multiple compartments.

BACKGROUND

Containers with multiple compartments capable of fanning out about a pivot axis are known. For example, U.S. Pat. No. 1,090,592 of Betham describes a display box for candy having stacked trays movably connected to a base via a pivot post such that the trays can be rotated about the pivot post to give access to the trays without disturbing the contents of the other trays. All the trays can be rotated to effectively display the contents therein. Other examples of containers with pivoting compartments can be found in the prior art.

The present inventors have identified a need for an aesthetically pleasing and functional gift box with multiple compartments that provide multiple opportunities for discovery and surprise. Additionally, the present inventors have identified a need for such a gift box assembled using lightweight, inexpensive, and environmentally responsible materials that can be composted or recycled once the items contained in the gift box have been consumed or used.

The present inventors have also identified the need for such a gift box that can be readily assembled at the site of packaging from sheets of foldable material, such as cardboard, wherein the sheets can be shipped and stored in a flat configuration. The inventors have identified the need to manufacture the flat components at a location remote from the site of packaging to reduce on-site equipment costs, while the flat, unassembled components reduce shipping costs and decrease storage space requirements.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
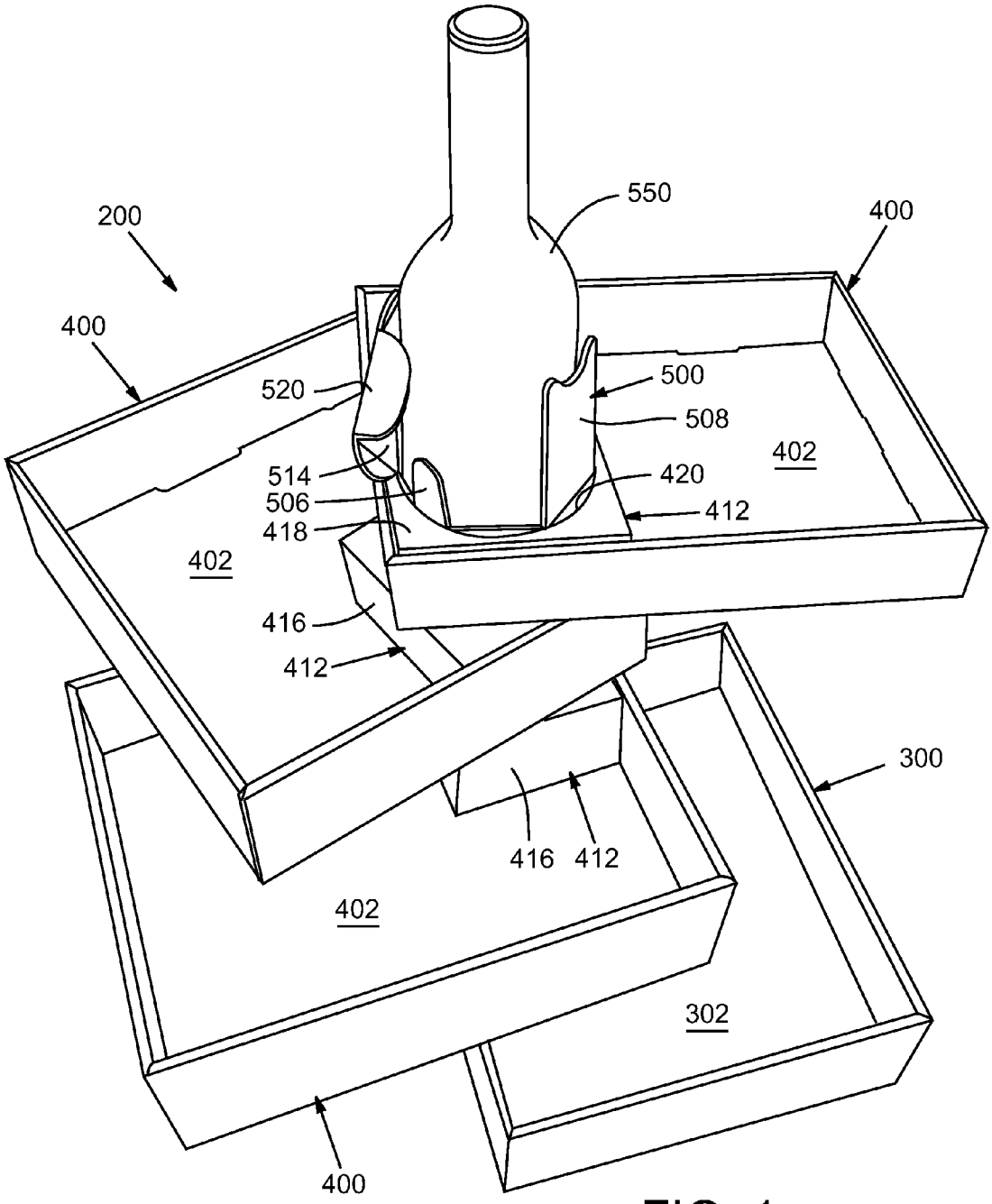
FIG. 1 is a pictorial view of a gift box in accordance with an exemplary embodiment, shown in an open condition with a storage sleeve of the gift box housing a bottle.

FIG. 1 illustrates an example embodiment of a gift box 200 in an open configuration. With reference to FIG. 1, gift box 200 may be used to store gift contents, such as food items, in each of a plurality of compartments 300, 400, 500. Gift box 200 includes a base compartment 300, at least one stacking compartment 400, and a storage sleeve 500. Base compartment 300 and stacking compartments 400 may each include side walls for retaining items therein and a pedestal 412 having openings sized to engage storage sleeve 500. Base compartment 300 and stacking compartments 400 may be supported on storage sleeve 500 such that storage sleeve 500 acts as a pivot axis allowing stacking compartments 400 to be individually rotatable about the storage sleeve 500. Rotation of the individual stacking compartments 400 about the storage sleeve 500 allows a gift recipient to open the compartments in stages to reveal the gift contents contained therein. Additionally, storage sleeve 500 may also be used as a separate storage compartment for a wine bottle 550, another elongate container (not shown), or other items altogether, such as candy. In some embodiments, the gift items are freely removable without affecting the structural integrity of gift box 200. The wine bottle 550 or other items stored in storage sleeve 500 may add rigidity to the pivot axis. Gift box 200 is preferably formed entirely from recyclable and/or compostable materials.

Figure 2:
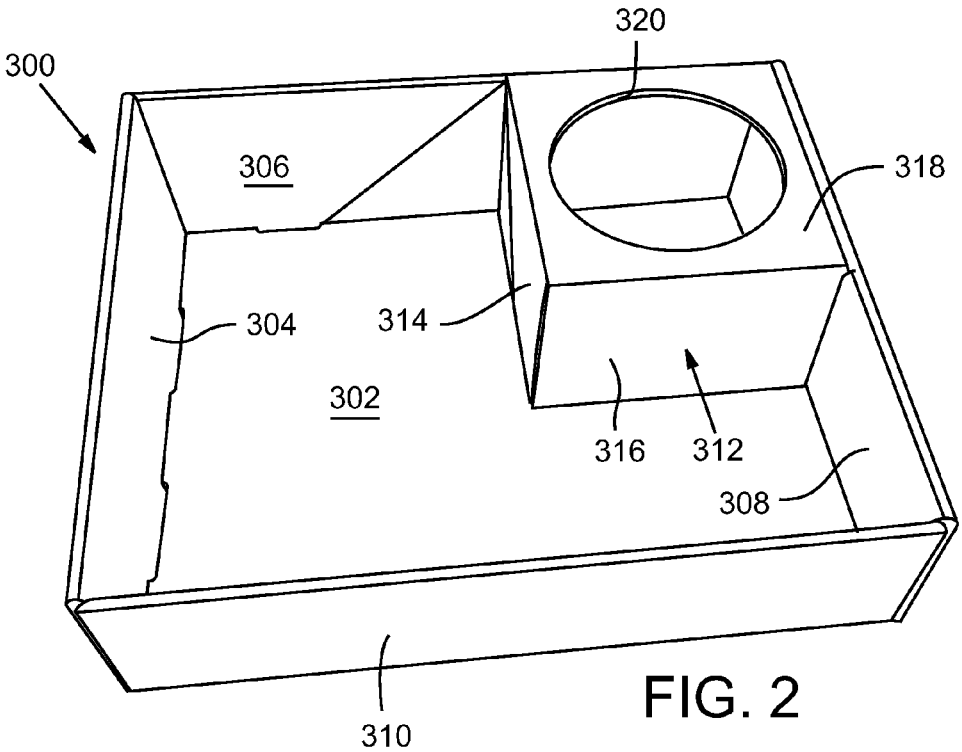
FIG. 2 is a pictorial view of a base compartment of the gift box of FIG. 1 in a folded configuration according to one example embodiment.
Figure 3:
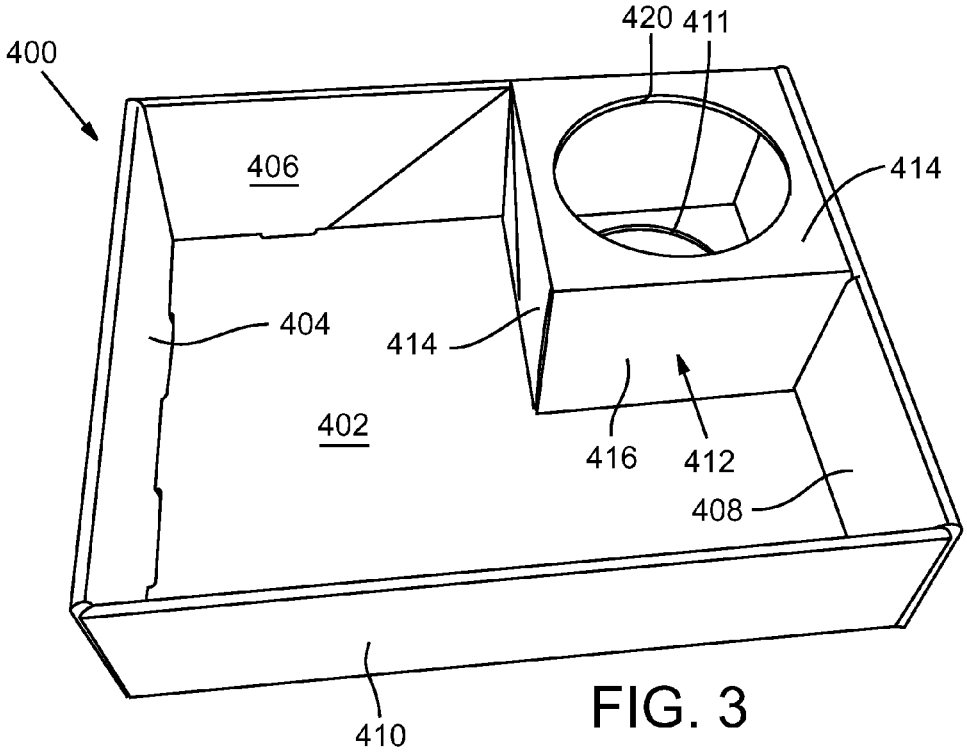
FIG. 3 is a pictorial view of a stacking compartment of the gift box of FIG. 1 in a folded configuration according to one example embodiment.
Figure 4:
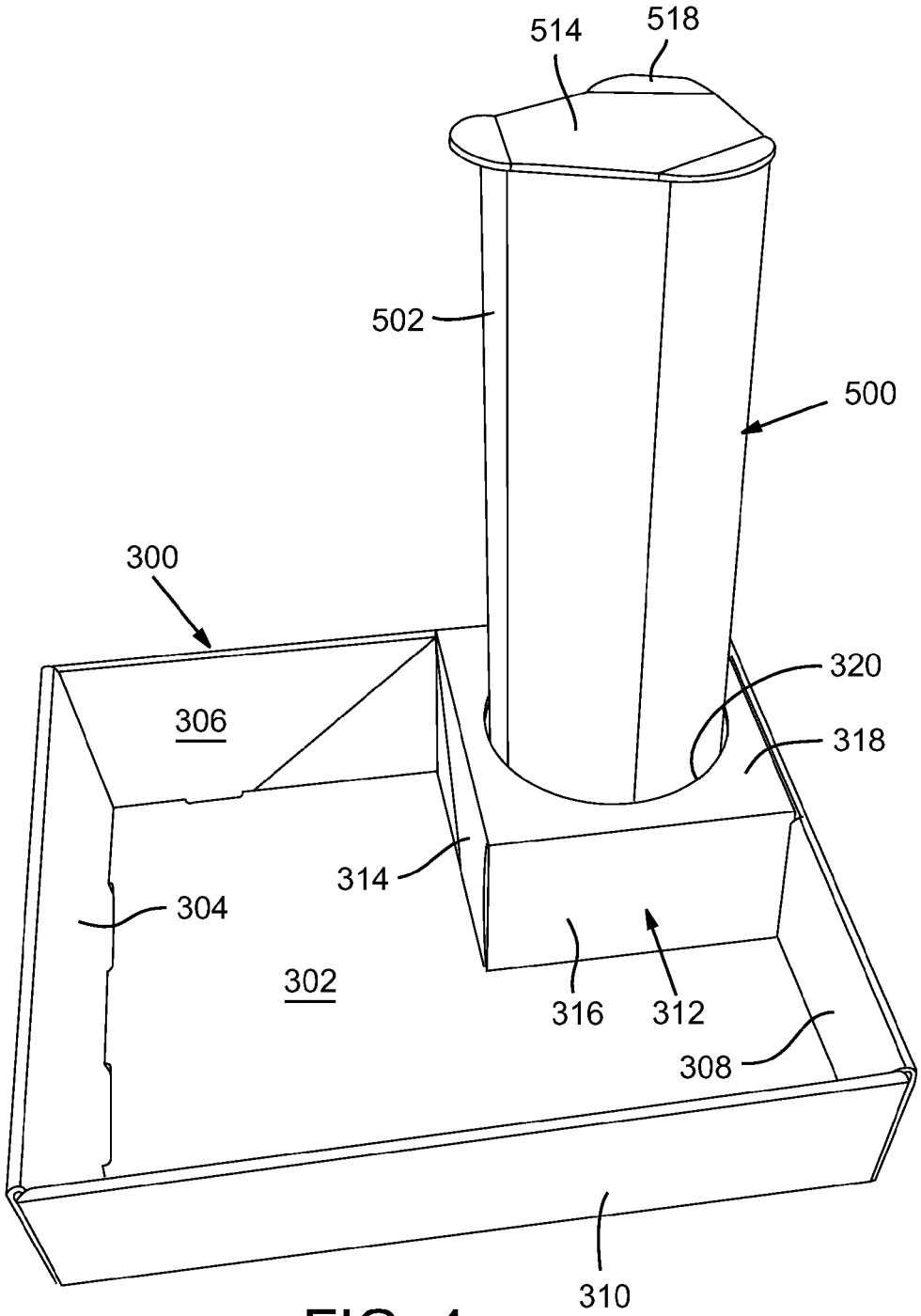
FIG. 4 is a pictorial view of the base compartment of FIG. 2 with the storage sleeve of FIG. 1 engaging the opening on the pedestal of the base compartment according to one example embodiment.

FIGS. 2-4 illustrate an example embodiment of basic components of gift box 200. Base compartment 300, stacking compartment 400, and storage sleeve 500 are made from cardboard or another manually foldable boardlike material, such as solid or corrugated plastic sheet material, which may be made of polypropylene, polyurethane, or another resin. When the gift contents are ready for packaging, base compartment 300, stacking compartment(s) 400, and storage sleeve 500 can be folded from the foldable material, and gift box 200 can be readily assembled at the site of packaging.

Figure 7:
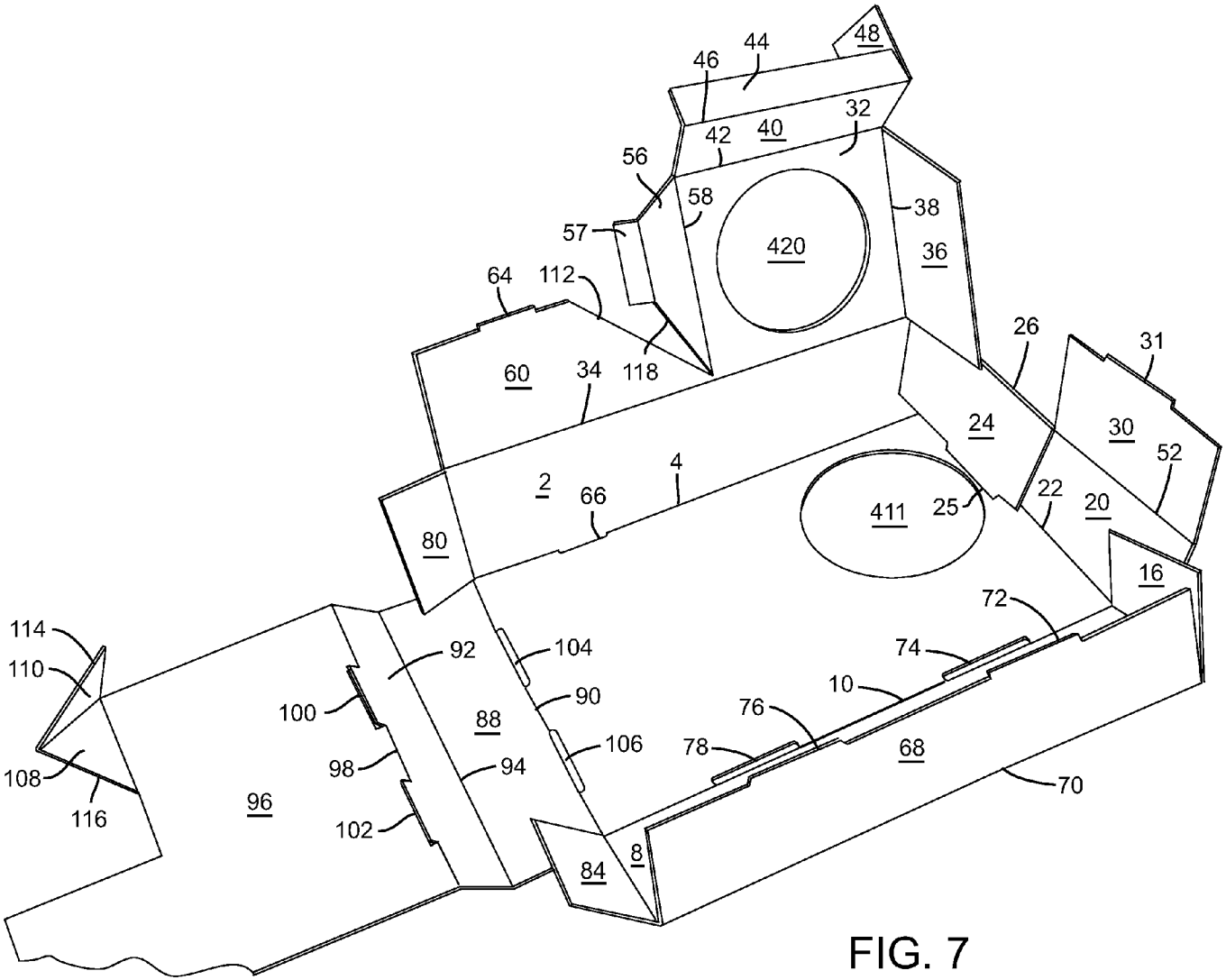
FIG. 7 is a partially assembled view of the stacking compartment of FIG. 3 being folded from the sheet of FIG. 6.

FIG. 2 illustrates a base compartment 300 according to an example embodiment. Base compartment 300 may be folded from a unitary sheet of foldable material, such as corrugated fiberboard, in a folding process as described below with reference to FIG. 5, or it may be assembled using a different process. Base compartment 300 includes a bottom wall 302 and may include side walls 304, 306, 308, and 310. Base compartment 300 may also include a raised pedestal 312. Pedestal 312 may be supported on adjoining side walls 306 and 308 and may include side panels 314 and 316 and a top panel 318 spaced apart from bottom wall 302, the top panel 318 having an opening 320 sized to engage the vertically elongate body 502 of storage sleeve 500 (FIG. 7).

Pedestal 312 may be folded from the same unitary sheet of foldable material as the base compartment 300. Alternatively, pedestal 312 may be folded or otherwise constructed separately and then attached to base compartment 300 using any method of fastening, such as using an adhesive or staple to attach pedestal 312 to bottom wall 302 and/or side walls 306, 308. In other embodiments, pedestal 312 may be supported along three side walls, such as side walls 306, 308, and 310, or supported only by one side wall, such as side wall 308, or unsupported by any side walls and positioned in the center of bottom wall 302. Other configurations not explicitly described herein may be possible.

In some embodiments (not shown), base compartment 300 can be arranged to include no side walls or any number of side walls as desired. For example, base compartment 300 can include three side walls in a triangular configuration and pedestal 312 can be positioned and supported along any one or more of the side walls. In other embodiments, the length, width, height, and overall dimension of base compartment 300 and its component parts can vary as desired.

FIG. 3 illustrates a stacking compartment 400 according to an example embodiment. Stacking compartment 400 may be similar in design and construction to base compartment 300, but stacking compartment 400 preferably includes an additional opening 411, in bottom wall 402, which is substantially aligned with opening 420 in top panel 412. The 400-series reference numerals in FIG. 3 identify parts of stacking compartment 400 having the same name and similar function as parts of base compartment 300 having similar 300-series reference numerals. For example, bottom walls of base compartment 300 and stacking compartment 400 are identified by reference numerals 302 and 402, respectively.

FIG. 4 illustrates base compartment 300 with the storage sleeve 500 fitted and supported in opening 320 of pedestal 312 according to one example embodiment. Storage sleeve 500 includes a vertically elongate tubular body 502 dimensioned to fit opening 320. Storage sleeve 500 may be folded from a unitary sheet of foldable material, such as corrugated fiberboard. Storage sleeve 500 is preferably attached to bottom wall 302 using glue, staples, adhesives, or other similar attachment methods. In another embodiment (not shown), base compartment 300 is eliminated, storage sleeve 500 includes a base flange, and a set of stacking compartments are slidably fitted onto storage sleeve 500 for individual rotation thereabout, such that the bottom-most stacking compartment rests on the base flange of the storage sleeve.

Figure 5:
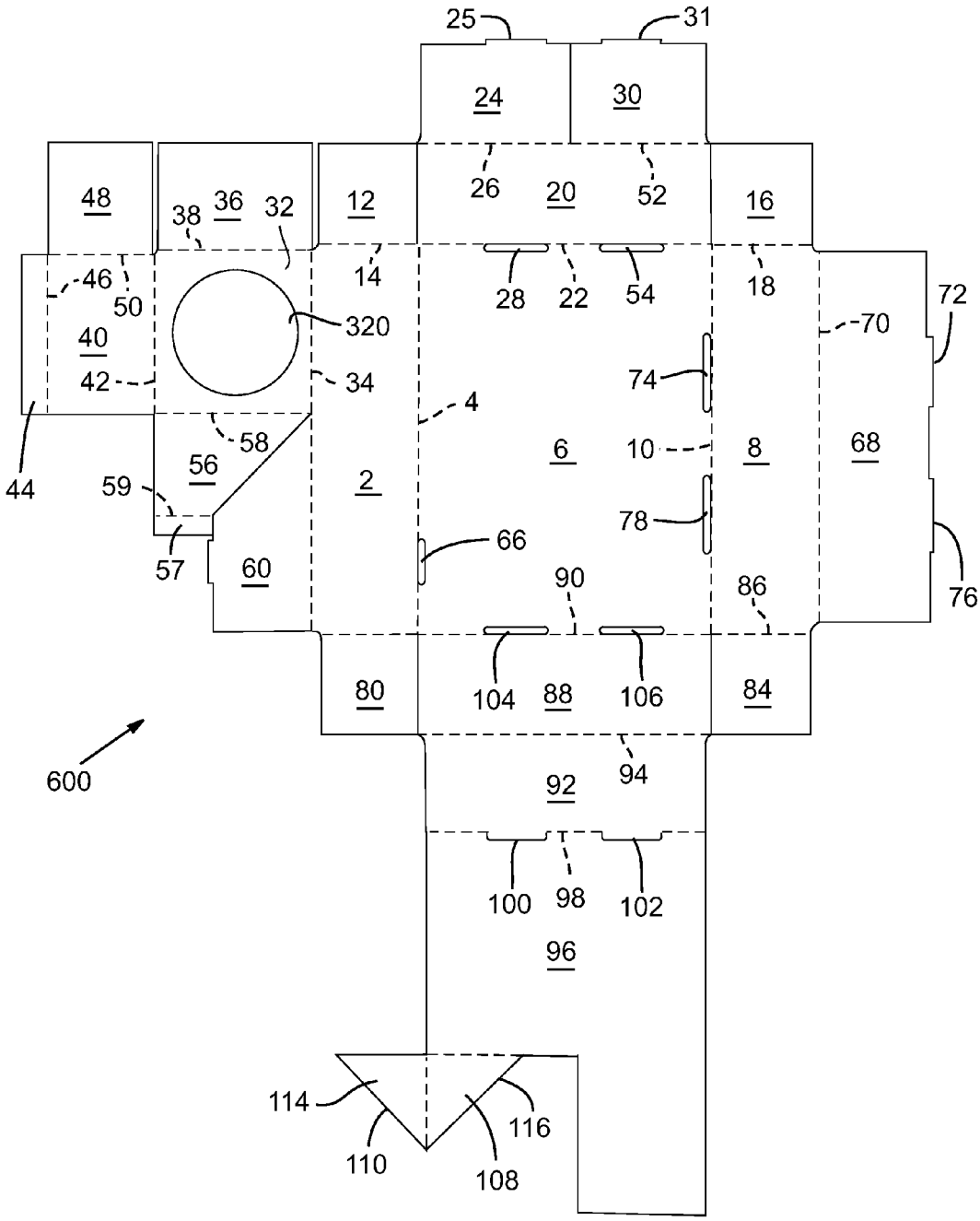
FIG. 5 is a top view of a flat, unfolded, die-cut sheet of foldable material for assembling into the base compartment of FIG. 2.

FIG. 5 illustrates a flat, unfolded sheet 600 of foldable material cut to a shape from which base compartment 300 is assembled according to one example embodiment. The sheet 600 is cut by die-cutting or another method to define a base panel 6 and a series of side panels 2, 8, 20, 88 extending along the margins of base panel 6. Other tabs, flaps, and panels 12, 16, 24, 30, 32, 36, 40, 48, 56, 60, 68, 80, 84, 92, 96 are arranged around side panels 2, 8, 20, 88, and comprise other supporting aspects of base compartment 300. Notably, pedestal top panel 32 and surrounding pedestal panels 36, 40, 48, 56 are folded over base panel 6 to form pedestal 312, as shown in FIG. 2.

Figure 6:
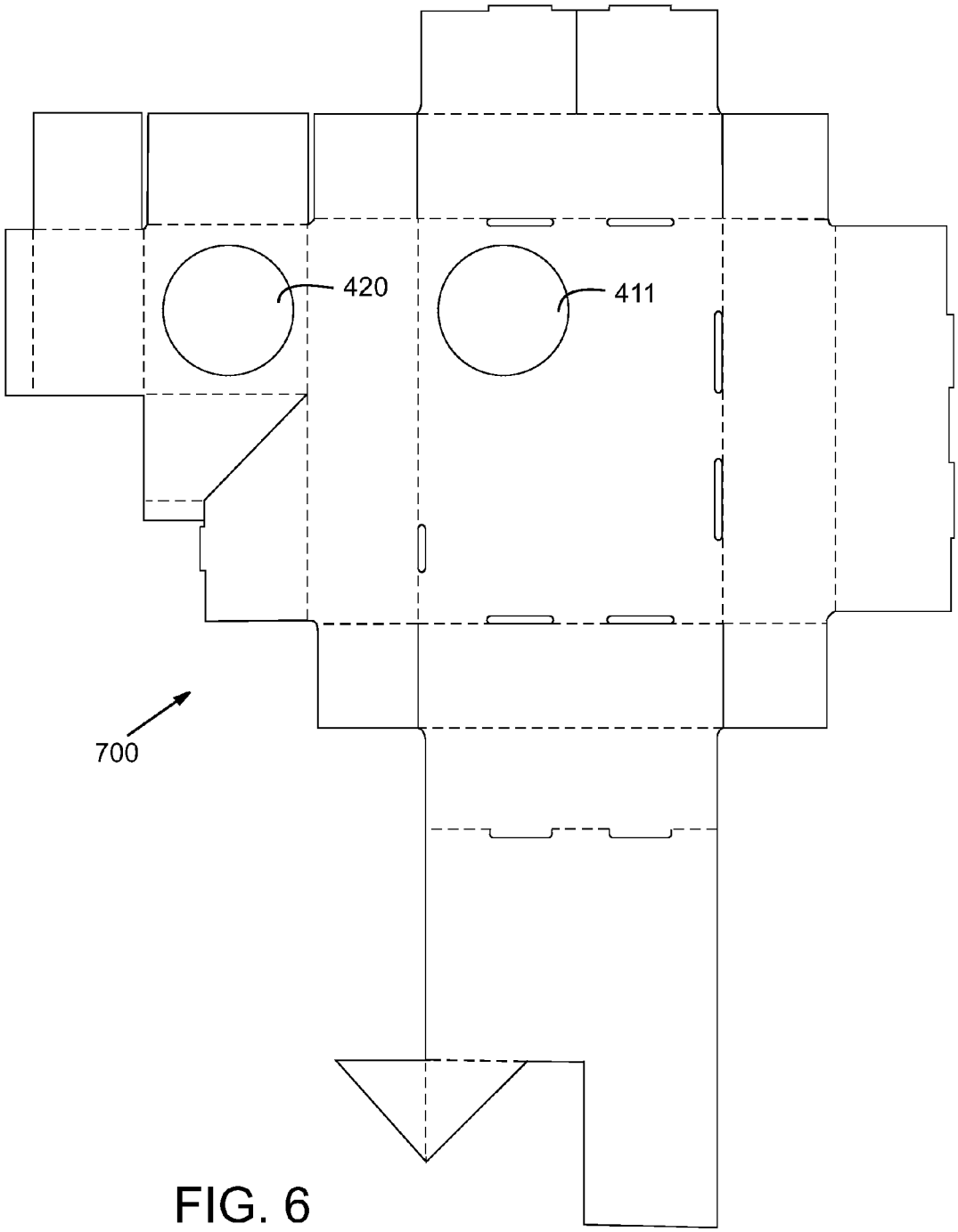
FIG. 6 is a top view of a flat, unfolded, die-cut sheet of foldable material for assembling into the stacking compartment of FIG. 3.

Similarly, FIG. 6 illustrates a flat, unfolded, die-cut sheet 700 of foldable material from which a stacking compartment 400 is assembled according to one example embodiment. The sheet 700 from which stacking compartment 400 is assembled may be substantially similar to the die-cut sheet 600 for the base compartment 300. For example, sheet 700 may have a perimeter and layout that is identical to sheet 600. However, the die-cut sheet 700 for stacking compartment 400 includes the additional opening 411, cut in base panel 6. Both die-cut sheets 600, 700 can be folded according to the folding process described in the following paragraphs. During manufacturing, sheets 600, 700 may be pre-creased and/or prescored between adjacent panels, flaps, and tabs to facilitate the folding and assembly of the compartments.

With reference to FIGS. 5-7, first side panel 2 is folded along crease 4 toward base panel 6 until first side panel 2 is upright and substantially perpendicular in relation to base panel 6. Next, second side panel 8, which is located opposite first side panel 2, is folded along crease 10 toward base panel 6 until second side panel 8 is upright and substantially perpendicular in relation to base panel 6. First and second side panels 2 and 8 should now face each other. First and second side panels 2 and 8 form a first layer of what will ultimately be side walls 306 and 310, respectively (FIG. 2).

Next, a side tab 12 extending from a first end of first side panel 2 is folded inwardly along crease 14 until side tab 12 is upright and substantially perpendicular in relation to first side panel 2 and bottom base panel 6. Similarly, a side tab 16 extending from a first end of second side panel 8 is folded inwardly along crease 18 until substantially perpendicular to second side panel 8 and base panel 6. Next, a third side panel 20 is folded along crease 22 toward base panel 6 until third side panel 20 rests against side tabs 12 and 16. A first flap 24 extending from third side panel 20 is then folded along crease 26, over side tab 12, and a tab 25 located on first flap 24 is inserted into a slot 28 located on base panel 6 adjacent crease 22. Side tab 12 now rests between third side panel 20 and first flap 24, forming a first layer that will ultimately be part of side wall 308 (FIG. 2). At this stage, a second flap 30 extending from third side panel 20 adjacent first flap 24 should be unfolded and upright.

Next, the pedestal 312 (FIG. 2) is assembled and supported at its base by base panel 6 and along one side by third side panel 20. First, a pedestal top panel 32 extending from first side panel 2 is folded along crease 34 and a pedestal back wall 36 extending from pedestal top panel 32 is folded along crease 38, as illustrated in FIG. 7, so that pedestal top panel 32 and pedestal back wall 36 are substantially perpendicular in relation to each other. Pedestal top panel 32 should be folded until it is substantially perpendicular with side panel 2 and in parallel spaced-apart relation with base panel 6 such that pedestal back wall 36 rests flush against first flap 24. Next, a first pedestal tab 44 extending from pedestal side wall 40 is folded along crease 46 so that pedestal side wall 40 and first pedestal tab 44 form an L-shape with respect to each other. Next, a second pedestal tab 48 extending from pedestal side wall 40 is folded along crease 50 as illustrated in FIG. 7. Pedestal side wall 40 is then folded along crease 42 until pedestal side wall 40 sits substantially perpendicular to base panel 6, first pedestal tab 44 points toward second side panel 8, and second pedestal tab 48 rests against third side panel 20 and points toward second side panel 8. Next, second flap 30 is folded along crease 52, over second pedestal tab 48 and side tab 16, and a tab 31 on second flap 30 is inserted into a slot 54 in base panel 6 to secure second flap 30 and to anchor second pedestal tab 48 and side tab 16 between third side panel 20 and second flap 30, thereby completing side wall 308. Thereafter, a pedestal front wall 56 is folded along crease 58 toward base panel 6 and a tab 57 extending from pedestal front wall 56 is folded along crease 59 and rests along base panel 6. At this stage, tab 57 faces outward in relation to a pedestal opening 320 and points toward a fourth side panel 88. Next, a third flap 60 extending from first side panel 2 is folded along crease 62 and a tab 64 on third flap 60 is inserted into a slot 66 on base panel 6 located adjacent crease 4.

Finally, with reference to FIGS. 2, 5 and 7, bottom wall 302 and side walls 304, 306, and 310 are assembled. Side wall 310 is assembled by folding a side flap 68 extending from second side panel 8 along crease 70, and inserting a tab 72 and a tab 76 extending from side flap 68 into a slot 74 and a slot 78, respectively, in base panel 6 located adjacent crease 10. Next, side wall 304 is assembled by folding a side tab 80 extending from a second end of first side panel 2 along crease 82 and folding a side tab 84 extending from a second end of second side panel 8 along crease 86 until side tabs 80 and 84 are upright and substantially perpendicular in relation to base panel 6 and respective first and second side panels 2 and 8. Similarly, second side panel 8 and side tab 84 should be substantially perpendicular to each other and adjoin along crease 86. Next, a fourth side panel 88 is folded along crease 90 toward base panel 6 until fourth side panel 88 rests against tabs 80 and 84. Afterward, a flap 92 extending from fourth side panel 88 is folded along crease 94 and over tabs 80 and 84. Next, flap 96 is folded at crease 98, which will expose a tab 100 and a tab 102 along crease 98. Tabs 100 and 102 are then inserted into a slot 104 and a slot 106, respectively, in base panel 6 located adjacent crease 90. Next, bottom wall 302 is assembled by laying a flap 96 extending from a flap 92 flat across base panel 6. Flap 96 lays over first pedestal tab 44 and pedestal front wall tab 57 and helps anchor pedestal side wall 40 and pedestal front wall 56 of pedestal 312. To complete pedestal 312, pedestal front wall edge 118 located on pedestal front wall 56 is interlocked with first triangular flap edge 116 located on first triangular flap 108. Finally, to complete side wall 306, second triangular flap edge 114 located on second triangular flap 110 is interlocked with side panel edge 112 located on side panel 60.

Figure 8A:
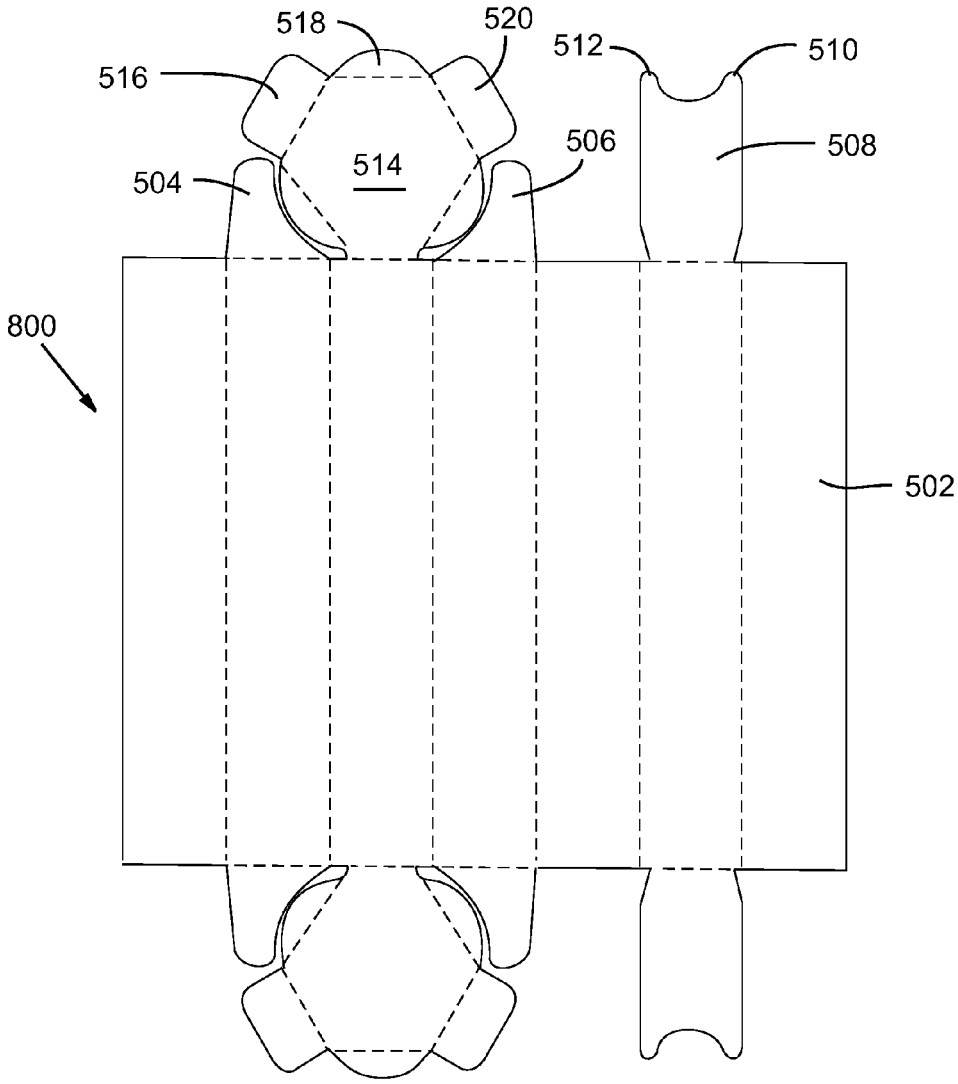
FIG. 8A is a top view of a flat, unfolded, die-cut sheet for forming a storage sleeve of the gift box of FIG. 1.
Figure 8B:
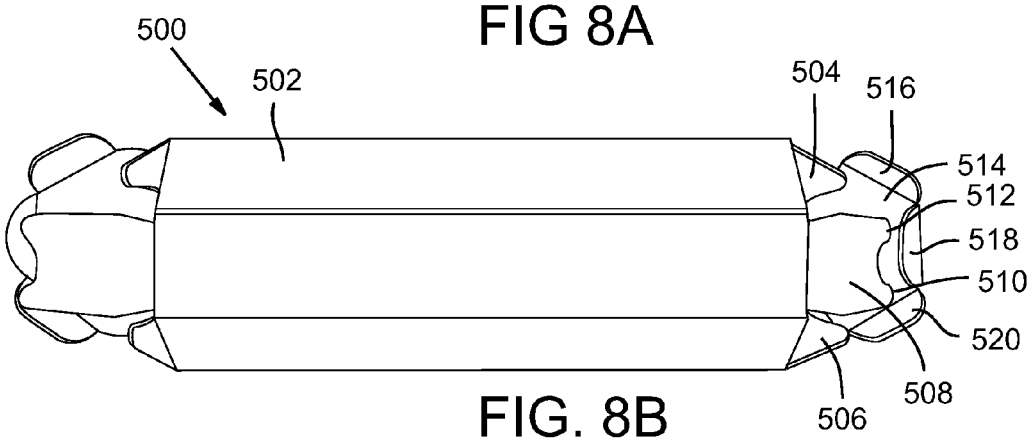
FIG. 8B is a side view of the storage sleeve of FIGS. 1 and 4, assembled from the flat sheet of FIG. 8A.

FIGS. 8A and 8B illustrate a flat, unfolded sheet 800 of foldable material cut to a shape from which storage sleeve 500 is assembled according to one example embodiment. The sheet 800 is cut by die-cutting or another method to define a vertically elongate body 502, a cover 514, cover tabs 516, 518, 520, and a series of flaps 504, 506, 508. Die-cut sheet 800 can be folded according to the folding process described in the following paragraph. During manufacturing, sheet 800 may be pre-creased and/or pre-scored between adjacent tabs and flaps to facilitate the folding and assembly process.

Figure 9:
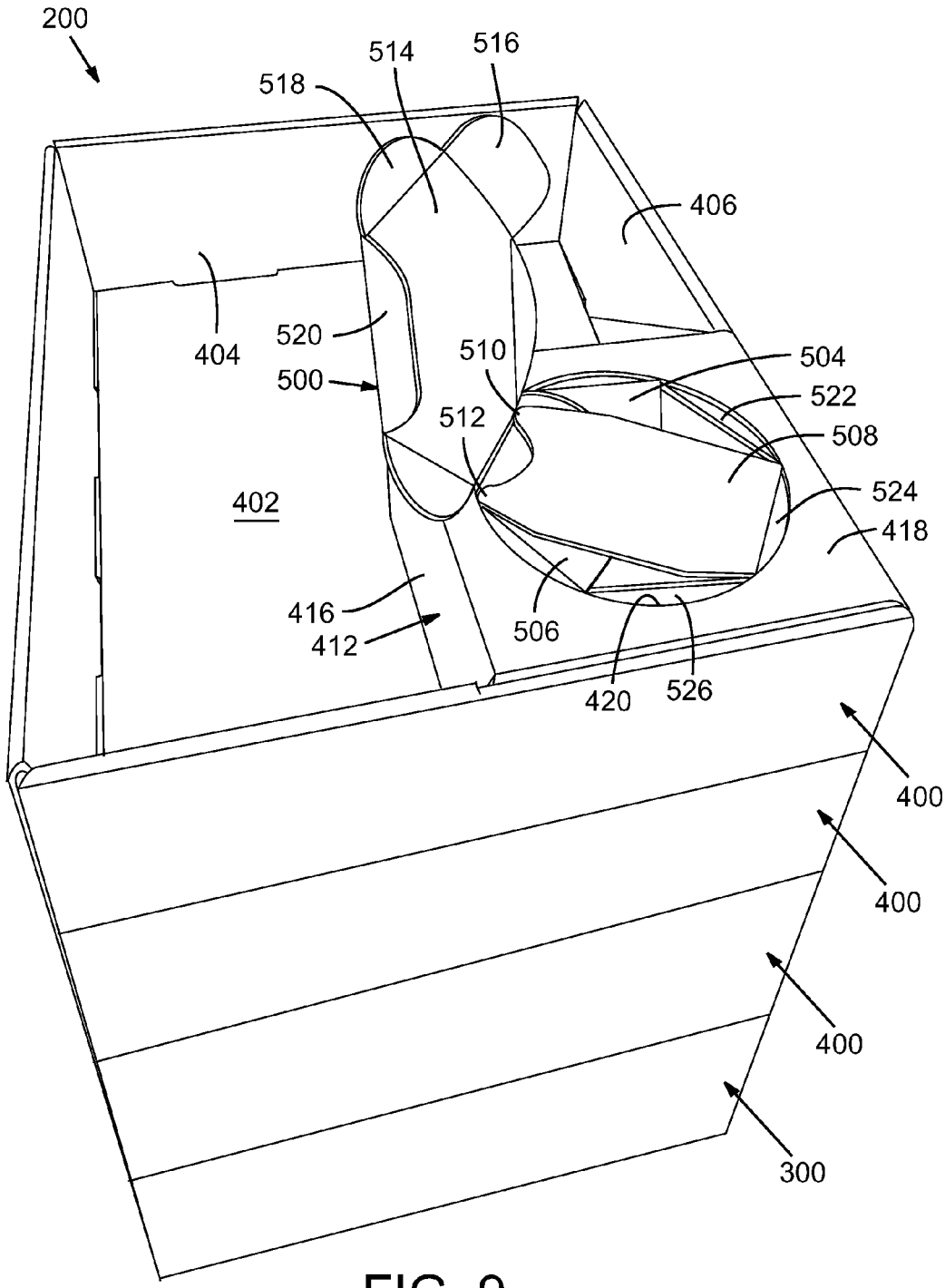
FIG. 9 is a top view of one end of the storage sleeve of FIG. 8B illustrating interlocking flaps.

With reference to FIGS. 8A, 8B and 9, the opposing edges of vertically-elongate body 502 are folded toward each other until the edges meet and a cavity is formed within storage sleeve 500. An adhesive or other fastening method can be used to adhere the edges of vertically-elongate body 502 to one another. Next, a first flap 504 and a second flap 506 extending from vertically-elongate body 502 are folded inwardly toward one another. A third flap 508 extending from vertically-elongate body 502 is folded over first and second flaps 504 and 506. Third flap 508 is folded until a first protrusion 510 and a second protrusion 512 on third flap 508 rest against the interior of vertically-elongate body 502. First and second flaps 504 and 506 rest against third flap 508 and third flap 508 is anchored within the vertically-elongate body 502. Next, a cover 514 extending from vertically-elongate body 502 is folded over flap 508. At this stage, cover tabs 516, 518, and 520 protrude outwardly as in FIG. 4, but once gift box 200 is fully assembled (FIGS. 9 and 10) cover tabs 516, 518, and 520 will be inserted into slots 522, 524, and 526 formed between pedestal 412 of the uppermost stacking compartment 400 and the exterior wall of vertically-elongate body 502. The same process as described above can be repeated for closing the opposite end of storage sleeve 500.

Figure 10:
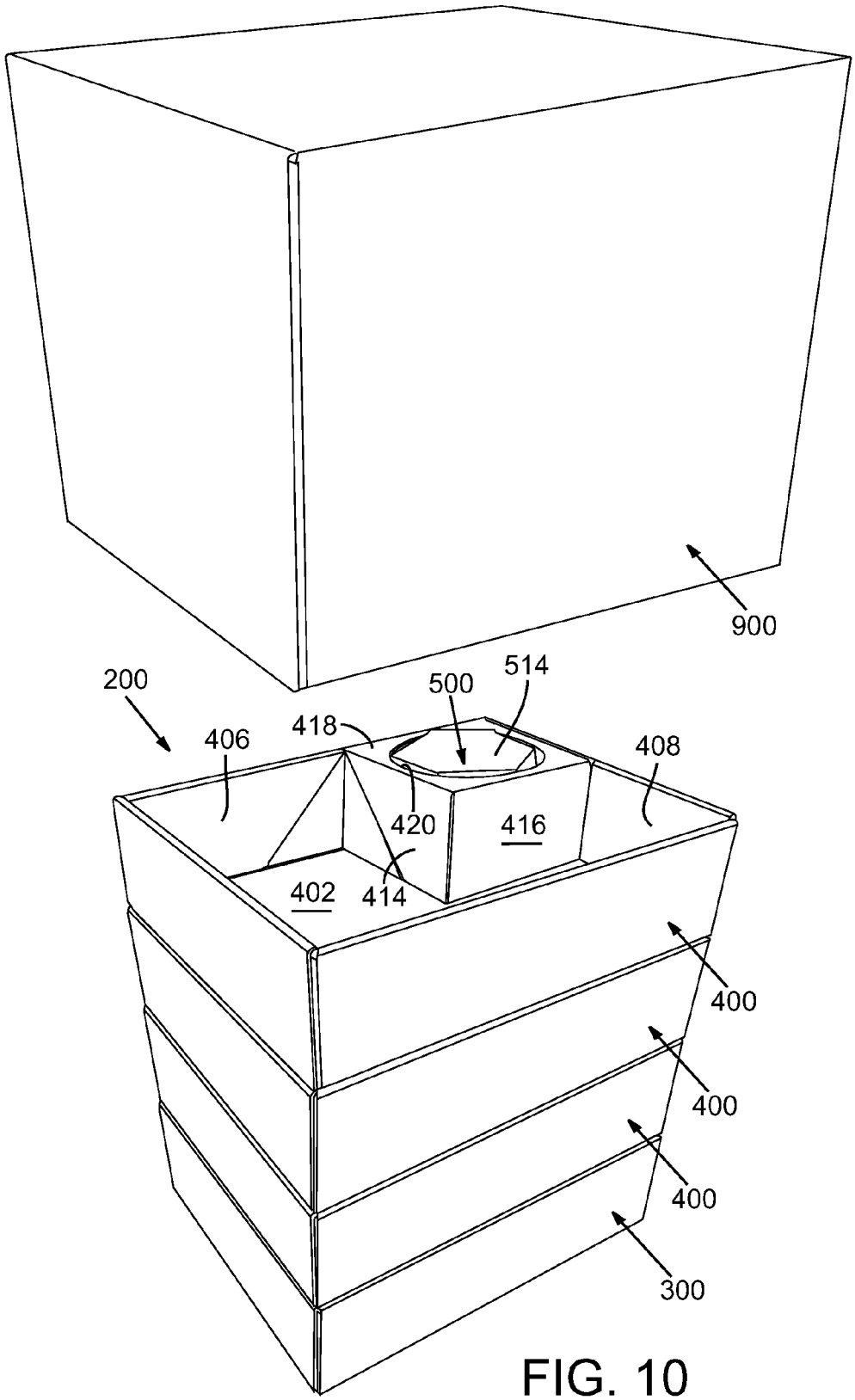
FIG. 10 is an orthogonal view of the gift box of FIG. 1 in a closed condition.

FIGS. 9 and 10 illustrate an assembled gift box 200 in a closed condition having a base compartment 300 and a plurality of stacking compartments 400. Additional stacking compartments 400 may be added to gift box 200 by sliding the vertically-elongate body 502 of storage sleeve 500 through the openings 411 and 420 of stacking compartment 400. Once gift box 200 is assembled, base compartment 300 and the plurality of stacking compartments 400 may be decorated and filled with food or other items as desired. The uppermost stacking compartment 400 may be used as a display for decorative features, such as bows, ribbons, confetti, and the like, or it may be used for storing food or other items. The uppermost stacking compartment 400 may also be used as a place for a greeting card, a message to the recipient of the gift box, or a message identifying the person giving the gift box. Other embodiments may use the uppermost stacking compartment for purposes other than those described herein.

Storage sleeve 500 may be used as an additional storage compartment for a gift item, such as a wine bottle 550 (FIG. 1) or similar container, which may add rigidity to the pivot axis. In another embodiment, if no food items are stored in storage sleeve 500, protective material, such as cardboard, polystyrene foam, or the like, may be stored therein to provide additional support for gift box 200. If a wine bottle 550 or other container is stored in storage sleeve 500, the gift recipient can open storage sleeve 500 and remove the contents stored therein. Removal of these contents should preferably not affect the structural integrity of gift box 200. If a recipient so desires, the recipient can also remove each of the stacking compartments 400 from the gift box 200 by opening the top end of the storage sleeve 500 and sliding the stacking compartments 400 off the storage sleeve 500.

In other embodiments, the dimensions of vertically-elongate body 502 of storage sleeve 500 and corresponding openings 320, 411, and 420 of base compartment 300 and stacking compartment 400 may vary to accommodate different sizes and shapes of containers stored therein. In yet another embodiment, storage sleeve 500 may be a pre-formed tube or other vertically elongate vessel, such as one made of cardboard or plastic, dimensioned to engage openings 320, 411, and 420.

With reference to FIG. 10, gift box 200 may include a cover 900 to provide additional protection, such as during shipping from the packing facility to the desired destination. Cover 900 may be made of cardboard, corrugated fiberboard, or another manually foldable boardlike material, such as solid or corrugated plastic sheet material. When a recipient of gift box 200 removes cover 900, the recipient will first experience the decoration and gifts found on the uppermost stacking compartment 400. The recipient can then continue individually fanning out each stacking compartment 400 to reveal the contents therein. Preferably, each stacking compartment 400 can be rotated about the storage sleeve 500 independent of the other compartments, and all compartments can be concurrently open and accessible while remaining supported by base compartment 300 and storage sleeve 500, as is shown in FIG. 1.

It will be obvious to those having skill in the art that many changes may be made to the details of the above-described embodiments without departing from the underlying principles of the invention. The scope of the present invention should, therefore, be determined only by the following claims.

The invention claimed is:

1. A gift box comprising:

a tubular sleeve having an elongate body;

a base compartment adapted to be supported on the sleeve, the base compartment having a front wall, a rear wall, and a pair of laterally spaced side walls; and a stacking compartment folded from a sheet of foldable material, the stacking compartment having a front wall, a rear wall, a pair of laterally spaced side walls, and a bottom wall, the bottom wall having a first opening and a pedestal fixedly supported over the bottom wall, the pedestal including a panel spaced apart from the bottom wall and having a second opening aligned with the first opening, the first and second openings sized and arranged to fit and slidably receive the elongate body of the sleeve such that the stacking compartment is positioned above the base compartment and rotatable about the sleeve relative to the base compartment, wherein, when the gift box is in a closed condition, the pair of laterally spaced side walls of the base compartment are aligned with the pair of laterally spaced side walls of the stacking compartment, and the front and rear walls of the base compartment are aligned with the front and rear walls of the stacking compartment.

2. The gift box of claim 1, wherein the base compartment is folded from a second sheet of foldable material and the sleeve is folded from a third sheet of foldable material.

3. The gift box of claim 1, wherein the bottom wall and pedestal of the stacking compartment are folded from a single unitary sheet of foldable material.

4. The gift box of claim 1, wherein:

the pedestal of the stacking compartment further includes two side walls, each of the side walls extending perpendicularly from the panel toward the bottom wall of the stacking compartment, and wherein at least one of the side walls is spaced apart from and parallel to the laterally spaced side walls of the stacking compartment, and wherein the pedestal is supported on the bottom wall of the stacking compartment by the two side walls.

5. The gift box of claim 1, wherein the elongate body of the sleeve is sized to receive a wine bottle, the sleeve having a cover for enclosing the wine bottle within the elongate body of the sleeve, and wherein the sleeve and cover are formed from a single unitary sheet of foldable material.

6. The gift box of claim 1, wherein the sleeve, base compartment and stacking compartment are made of corrugated fiberboard.

7. The gift box of claim 1, further comprising a second stacking compartment supported on and independently rotatable about the sleeve.

8. The gift box of claim 1, wherein a bottom end of the sleeve is rigidly attached to the base compartment.

9. The gift box of claim 1, further comprising a cover enclosing the sleeve, the base compartment, and the stacking compartment.

10. A gift box comprising:

a base compartment folded from a first unitary sheet of foldable material, the base compartment having a bottom wall and side walls, and further including a first pedestal having a first top panel with an opening, the first top panel spaced apart from the bottom wall of the base compartment, wherein the first pedestal further includes a side panel extending perpendicularly from the first top panel toward the bottom wall to support the first pedestal on the bottom wall of the base compartment, the side panel spaced apart from and parallel to at least one of the side walls of the base compartment;

a stacking compartment folded from a second unitary sheet of foldable material, the stacking compartment having a bottom wall with an opening and further including a second pedestal supported on the bottom wall of the stacking compartment, the second pedestal having a second top panel spaced apart from the bottom wall of the stacking compartment and including an opening aligned with the opening in the bottom wall of the stacking compartment; and a vertically-elongate sleeve dimensioned to engage the opening on the first pedestal, the opening on the second pedestal, and the opening on the bottom wall of the stacking compartment such that the sleeve forms a pivot axis for the stacking compartment wherein the stacking compartment is supported on and independently rotatable about the pivot axis for fanning out relative to the base compartment.

11. The gift box of claim 10 wherein the first and second unitary sheets of foldable material are made of corrugated fiberboard.

12. The gift box of claim 10 further comprising a second stacking compartment supported on and independently rotatable about the pivot axis.

13. The gift box of claim 10 wherein the first pedestal is formed from the first unitary sheet of foldable material and the second pedestal is formed from the second unitary sheet of foldable material.

14. The gift box of claim 10 wherein the stacking compartment includes four side walls.

15. The gift box of claim 10 wherein the first pedestal further includes a back panel extending perpendicularly from the first top panel toward the bottom wall of the base compartment, and wherein the back panel is supported against at least one of the base compartment side walls.

16. The gift box of claim 10 wherein the sleeve is folded from a third unitary sheet of foldable material.

17. The gift box of claim 16 wherein the third unitary sheet of foldable material is made of corrugated fiberboard.

18. The gift box of claim 10 wherein the sleeve is sized to receive a wine bottle, the sleeve having a cover for enclosing the wine bottle within the elongate body of the sleeve, and wherein the sleeve and cover are formed from a single unitary sheet of foldable material.

19. The gift box of claim 10 wherein a bottom end of the sleeve is rigidly attached to the bottom wall of the base compartment.

20. The gift box of claim 10 further comprising a cover enclosing the base compartment, the stacking compartment, and the sleeve.

* * * * *